US006364550B1

(12) United States Patent
Petteruti

(10) Patent No.: US 6,364,550 B1
(45) Date of Patent: Apr. 2, 2002

(54) PRINTER WEIGHING LESS THAN TWO POUNDS WITH CARD READER AND ENCODER

(75) Inventor: Steven F. Petteruti, East Greenwich, RI (US)

(73) Assignee: ZIH Corp., Wilmington, DE (US)

( * ) Notice: Subject to any disclaimer, the term of this patent is extended or adjusted under 35 U.S.C. 154(b) by 0 days.

(21) Appl. No.: 09/591,204

(22) Filed: Jun. 9, 2000

Related U.S. Application Data

(63) Continuation-in-part of application No. 09/151,591, filed on Sep. 11, 1998, now Pat. No. 6,004,053.
(60) Provisional application No. 60/141,317, filed on Jun. 25, 1999.

(51) Int. Cl.[7] ..... B41J 3/36; B41J 2/00
(52) U.S. Cl. ..... 400/88; 400/103
(58) Field of Search ..... 400/88, 103

(56) References Cited

U.S. PATENT DOCUMENTS

| | | | | |
|---|---|---|---|---|
| 3,389,402 A | | 6/1968 | Rosmanith | |
| 3,651,310 A | | 3/1972 | Link | |
| 3,728,522 A | | 4/1973 | Norwich | |
| 3,749,887 A | | 7/1973 | Giuliani | |
| 4,199,100 A | | 4/1980 | Wostl et al. | |
| 4,297,039 A | | 10/1981 | Lees | |
| 4,707,592 A | | 11/1987 | Ware | |
| 4,764,666 A | * | 8/1988 | Bergeron | 235/380 |
| 4,772,146 A | | 9/1988 | Saito et al. | |
| 4,848,941 A | | 7/1989 | Imaseki | |
| 4,896,166 A | | 1/1990 | Barker et al. | |
| 4,927,278 A | | 5/1990 | Kuzuya et al. | |
| 5,096,314 A | | 3/1992 | Komori et al. | |
| 5,208,446 A | | 5/1993 | Martinez | |

FOREIGN PATENT DOCUMENTS

| | | | |
|---|---|---|---|
| GB | 2 274 349 | * | 7/1994 |
| JP | 8-112951 | | 5/1996 |

(List continued on next page.)

*Primary Examiner*—John S. Hilten
*Assistant Examiner*—Charles H. Nolan, Jr.
(74) *Attorney, Agent, or Firm*—Kenneth J. LuKacher; Martin LuKacher

(57) ABSTRACT

A miniature printer is provided with a printer mechanism in a housing. A thermal printhead is fixedly mounted in the mechanism. The mechanism and the housing define a compartment for a roll of paper which is loosely disposed in the housing and is extended over the thermal printhead. The compartment is closed by a cover hinged to the housing at one end thereof. A platen roller is located in the cover in an opening larger than the shaft of the roller, which opening and cover provides a floating mount for the platen roller. A driven gear which rotates the platen roller is mounted on the shaft near one end thereof. A pair of hairpin springs have ends which are located in the path which the platen roller takes as the cover is closed and moves into engagement with the platen roller. The springs align the platen roller with the printing elements on the printhead and bias the platen roller into engagement with the printhead, while latching the platen roller and the cover in closed position. The driven gear on the shaft also is aligned with the last gear of a train of gears from a motor to drive the platen. The housing mounts the electronics of the printer, which are on a printed circuit board, and also a magnetic or smart card reader and encoder or separate magnetic card and smart card readers and encoders. The housing has another cover which extends from the cover carrying the platen roller and covers the housing while exposing an opening in the magnetic card reader and encoder across which a magnetic card may be swiped for reading the data or recording (encoding) new data on the magnetic track of the card. The other cover may have a separate receptacle for a smart card and an associated reader and encoder. The encoded card may be used as a smart card to enter places or operate devices, say in a hotel, casino or retail store.

15 Claims, 9 Drawing Sheets

U.S. PATENT DOCUMENTS 5,267,800 A 12/1993 Petteruti et al.
5,278,752 A 1/1994 Narita et al.
5,294,782 A 3/1994 Kumar
5,334,821 A 8/1994 Campo et al.
5,334,824 A 8/1994 Martinez
5,386,106 A 1/1995 Kumar
5,412,564 A * 5/1995 Ecer ..... 364/413.29
5,481,290 A 1/1996 Watanabe et al.
5,489,773 A 2/1996 Kumar
D372,730 S 8/1996 Saskaki
5,579,043 A 11/1996 Patry
5,640,002 A * 6/1997 Ruppert et al. ..... 235/472
5,661,634 A 8/1997 Obata et al
5,679,943 A 10/1997 Schultz et al.
5,779,371 A 7/1998 Aoyama et al.
5,806,993 A 9/1998 Petteruti et al.
5,876,129 A 3/1999 Suzuki
6,004,053 A 12/1999 Petteruti et al.
6,065,679 A * 5/2000 Levie et al. ..... 235/462.47

* cited by examiner

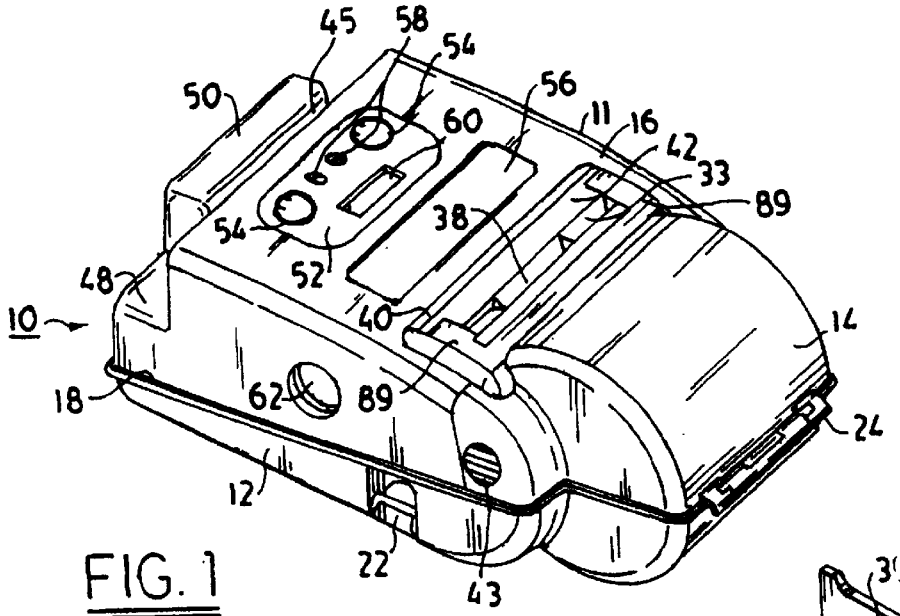
FIG. 1
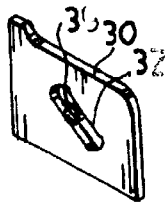
FIG. 2B
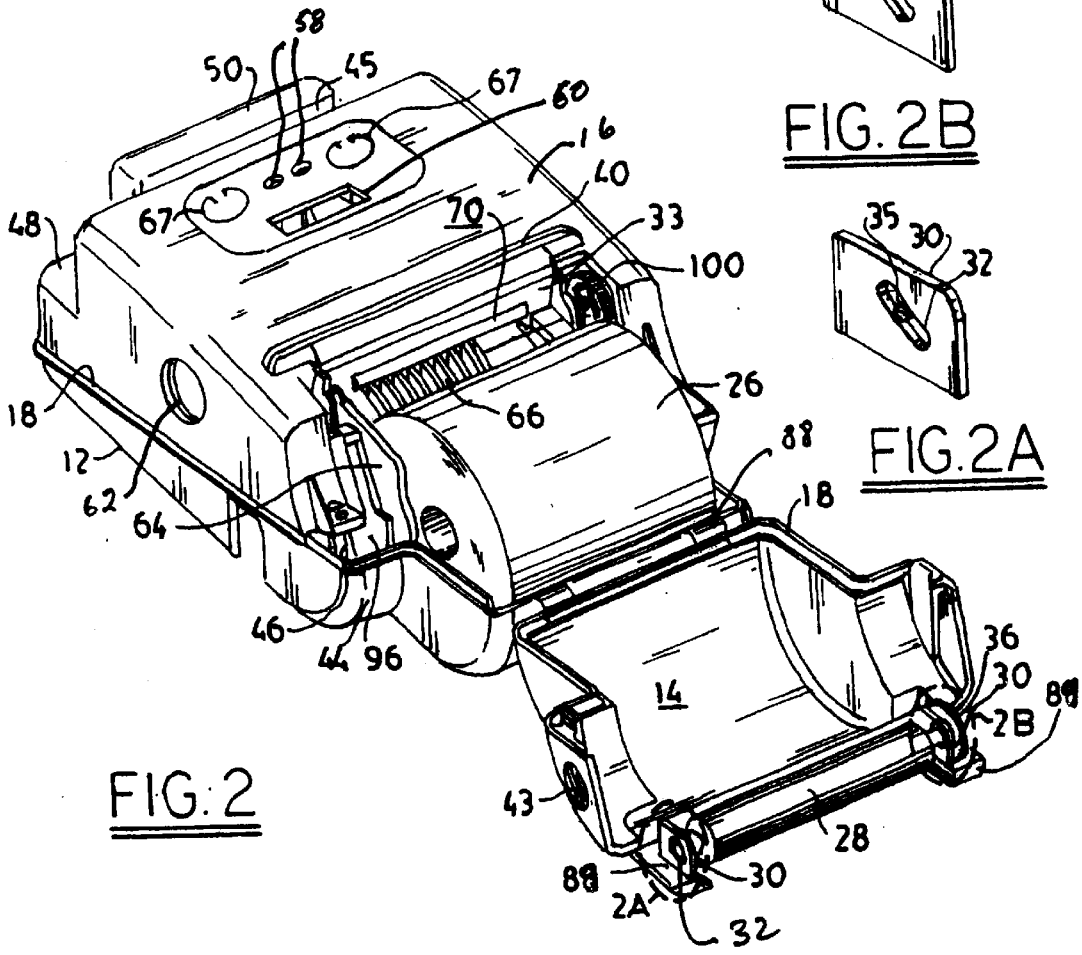
FIG. 2
FIG. 2A

PRINTER WEIGHING LESS THAN TWO POUNDS WITH CARD READER AND ENCODER

This application is a continuation in part of application Ser. No. 09/151,591 filed Sep. 11, 1998 by Steven F. Petteruti and Richard J. Preliasco now U.S. Pat. No. 6,004,053 issued Dec. 21, 1999 which claim benefit of Ser. No. 60/141,317 filed Jun. 25, 1999. The present invention relates to printer apparatus and more particularly to a miniaturized printer contained in a housing with a magnetic or smart card reader and encoder so as to provide an integrated printer, card reader/encoder unit.

DESCRIPTION

The invention provides an improved printer having a housing containing a printer mechanism which preferably has a thermal printhead and a platen is carried on a floating mount, which may be provided in a cover of the housing and enclosing a compartment containing a roll of paper which extends over the printhead and is maintained in driving relationship with the platen roller and in contact with the print elements of the head when the cover is moved to a closed position. Springs are mounted in the printing mechanism and allowed to flex. These springs are interactive with the platen roller so as to permit the platen roller to move into engagement with the printhead and, when in engagement, to bias and latch the platen roller against the printhead while aligning the platen roller with the printhead. In addition, a gear on the platen roller engages gears in a gear train driven by a motor and aligns itself with these gears to transfer power to the platen roller for driving the paper during printing operations. The housing has facilities for receiving and reading from and encoding on a data card (a magnetic and/or smart card, having an IC chip). The printer may be miniaturized for portable operation when carried by a user who can enter information via the card for printing, together with other information which may be entered from a terminal connected to the printer or from a remote host computer via wire line, infrared or radio link. Data may be encoded on the card by recording thereon data entered via a terminal, a keyboard on the printer housing, or transmitted from the host. The card so encoded may be used for gaining access to a facility or for operating various devices requiring external data to be operated, as for example in a hotel for room access (a card key) or in a casino for operating gambling machines, or as a debit card. The encrypted data on the card may be passed directly by to the terminal or host computer without printer processing.

It is a feature of the invention to provide an improved printer which is combined in the same unit with a magnetic card or smart card reader and encoder or both such card readers and encoders, other I/O device in a unitary structure adapted for personal use.

It is a still further object of the present invention to provide an improved miniaturized, hand holdable printer having a printing mechanism, associated in the same unit with a magnetic card and/or smart card.

The foregoing and other objects, features and advantages of the invention as well as a presently preferred embodiment thereof will become more apparent from a reading of the following description in connection with the accompanying drawings, brief descriptions of which are as follows.

FIG. 1 is a perspective view of a miniaturized printer and card reader and encoder unit embodying the invention;

FIG. 2 is a perspective view of the printer/card reader and encoder unit shown in FIG. 1 with a cover which captures a roll of paper on which printing is carried out, the cover being in open position;

Figure 3:
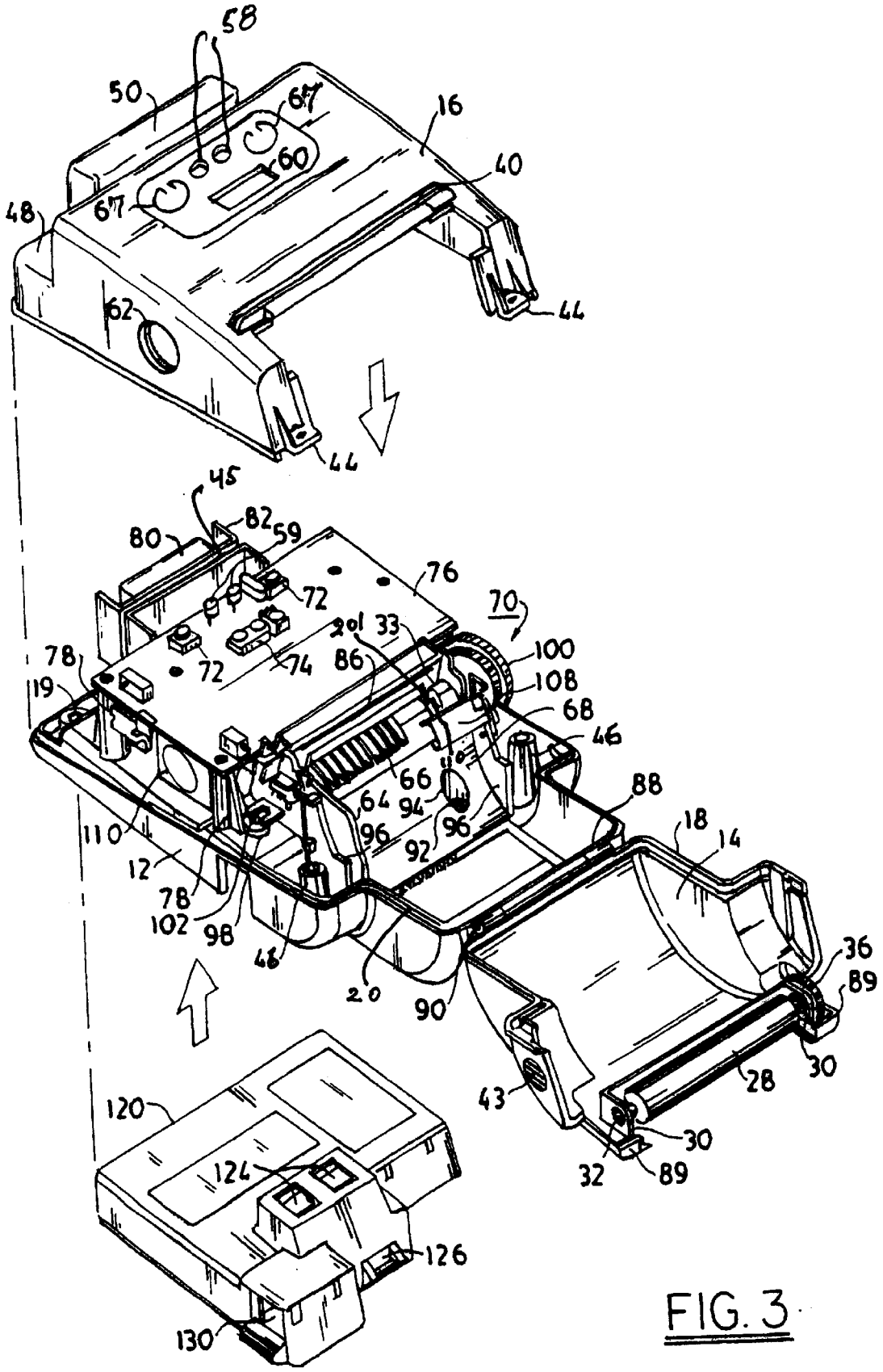
Figure 5:
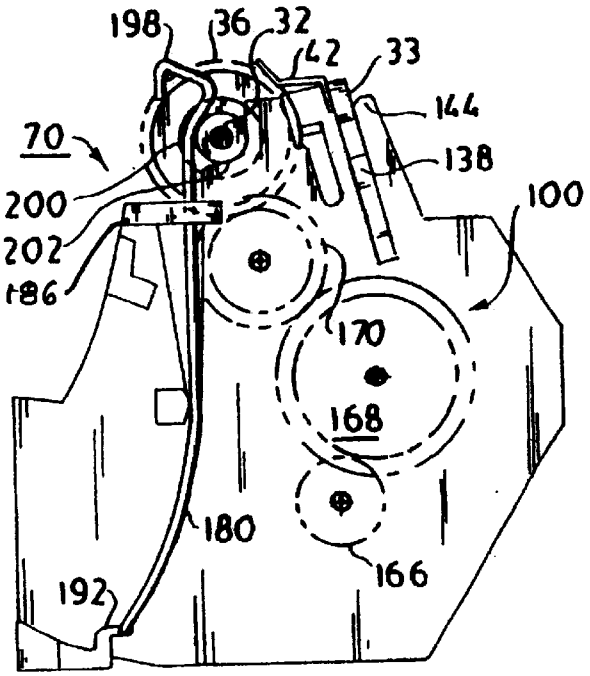
Figure 4:
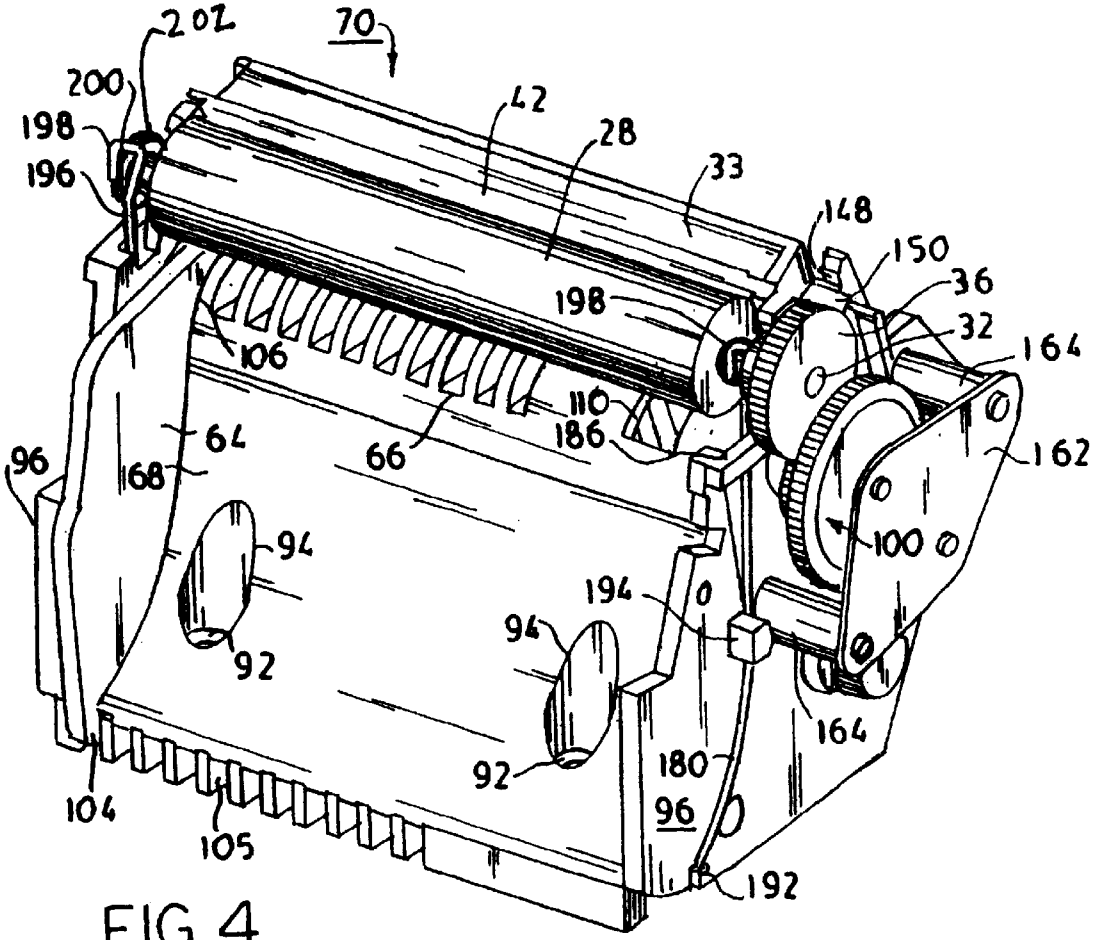
Figure 6:
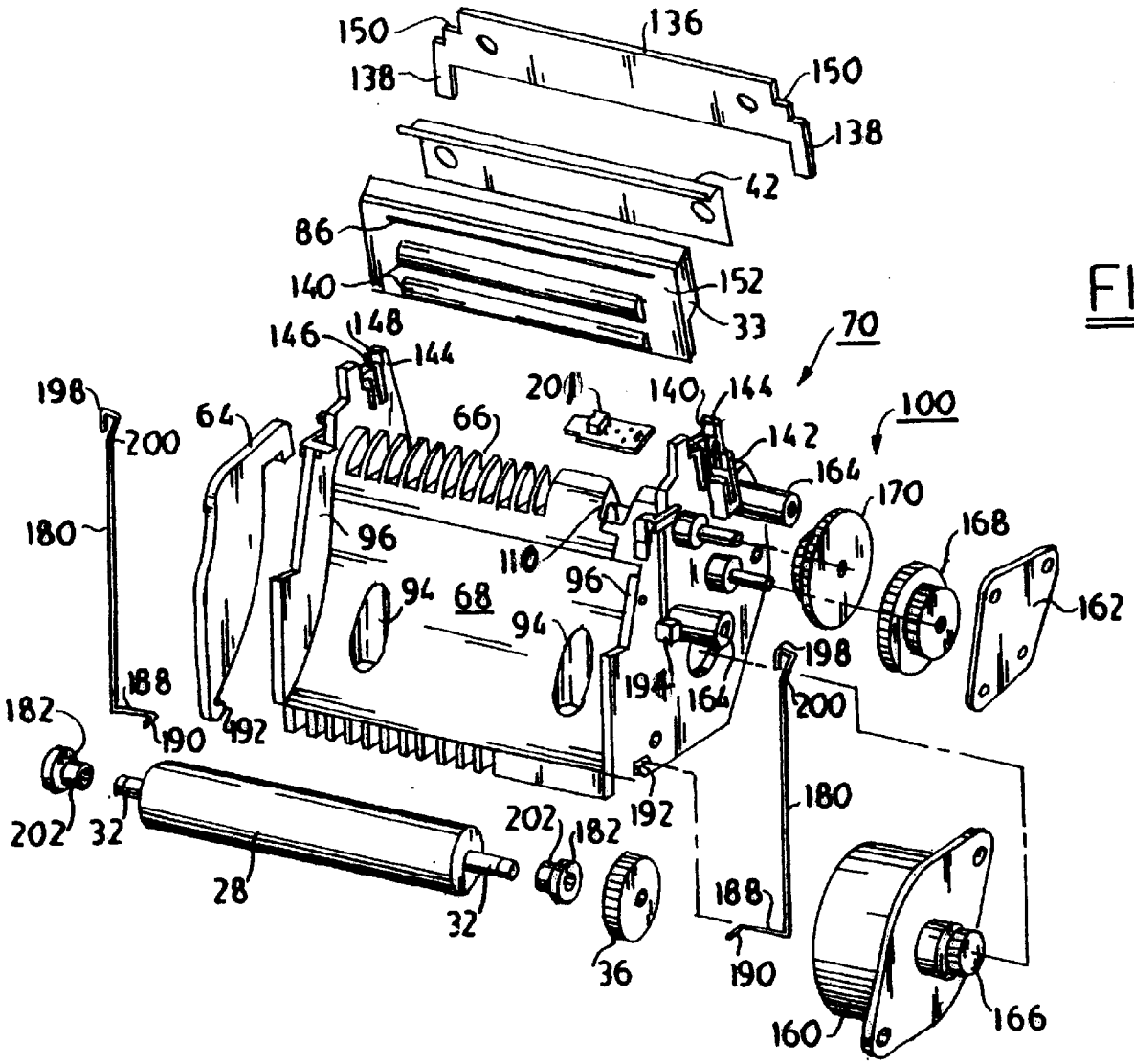
Figure 7:
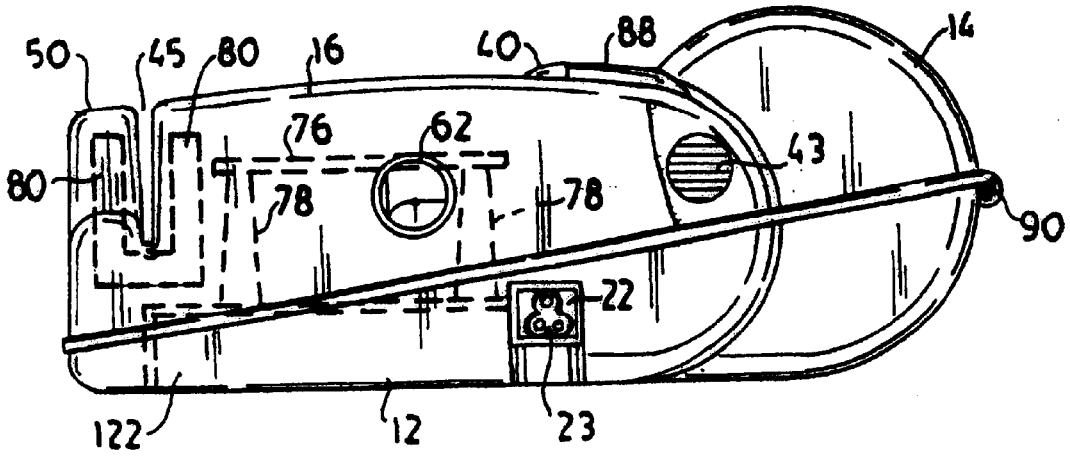
Figure 8:
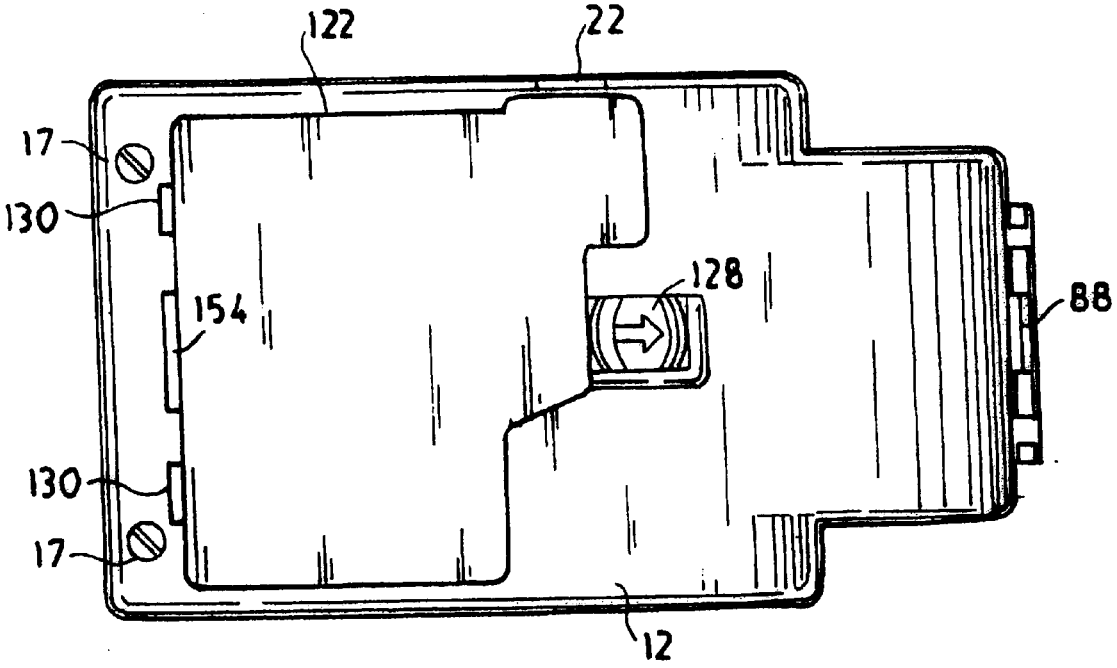
Figure 9:
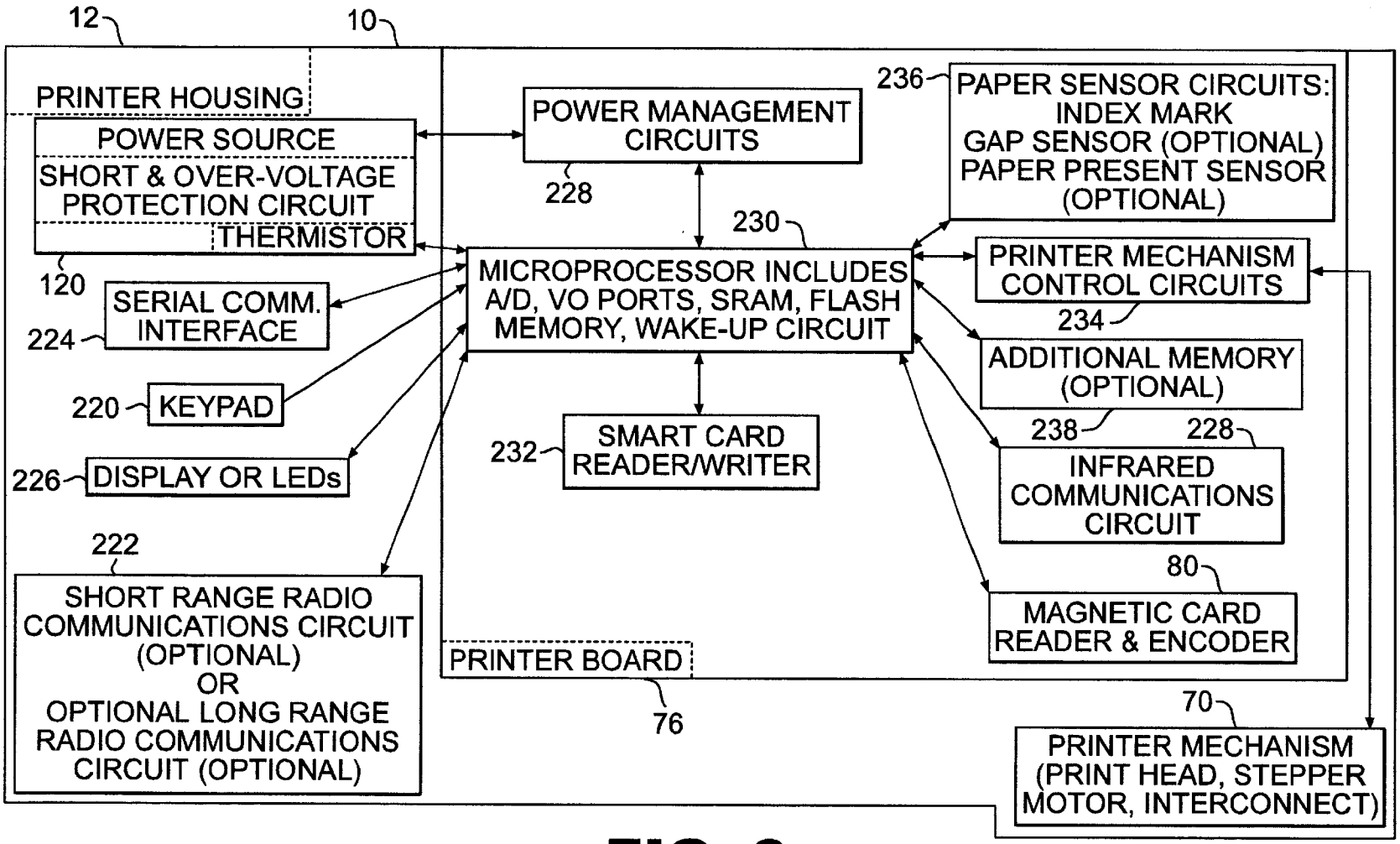
Figure 10:
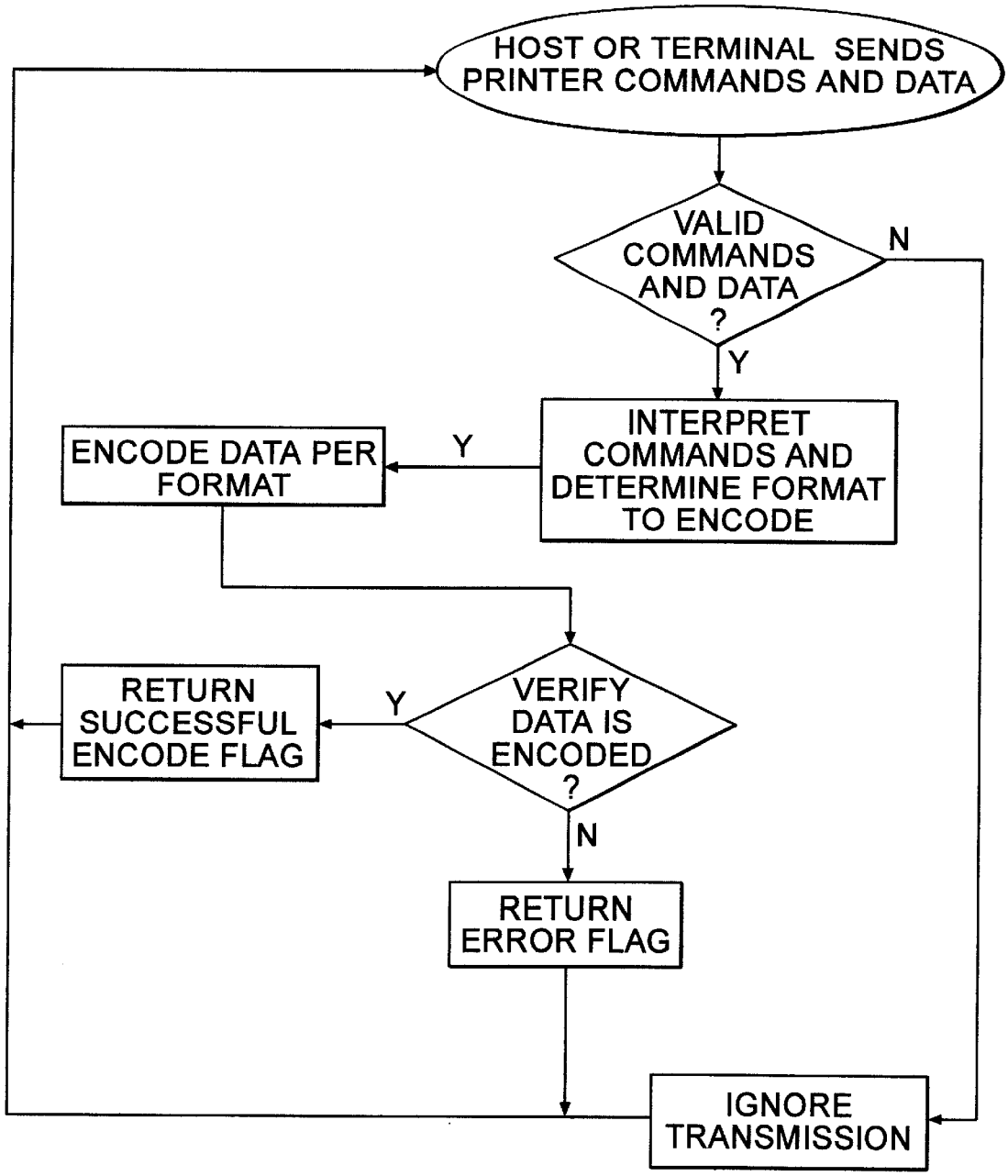
Figure 11:
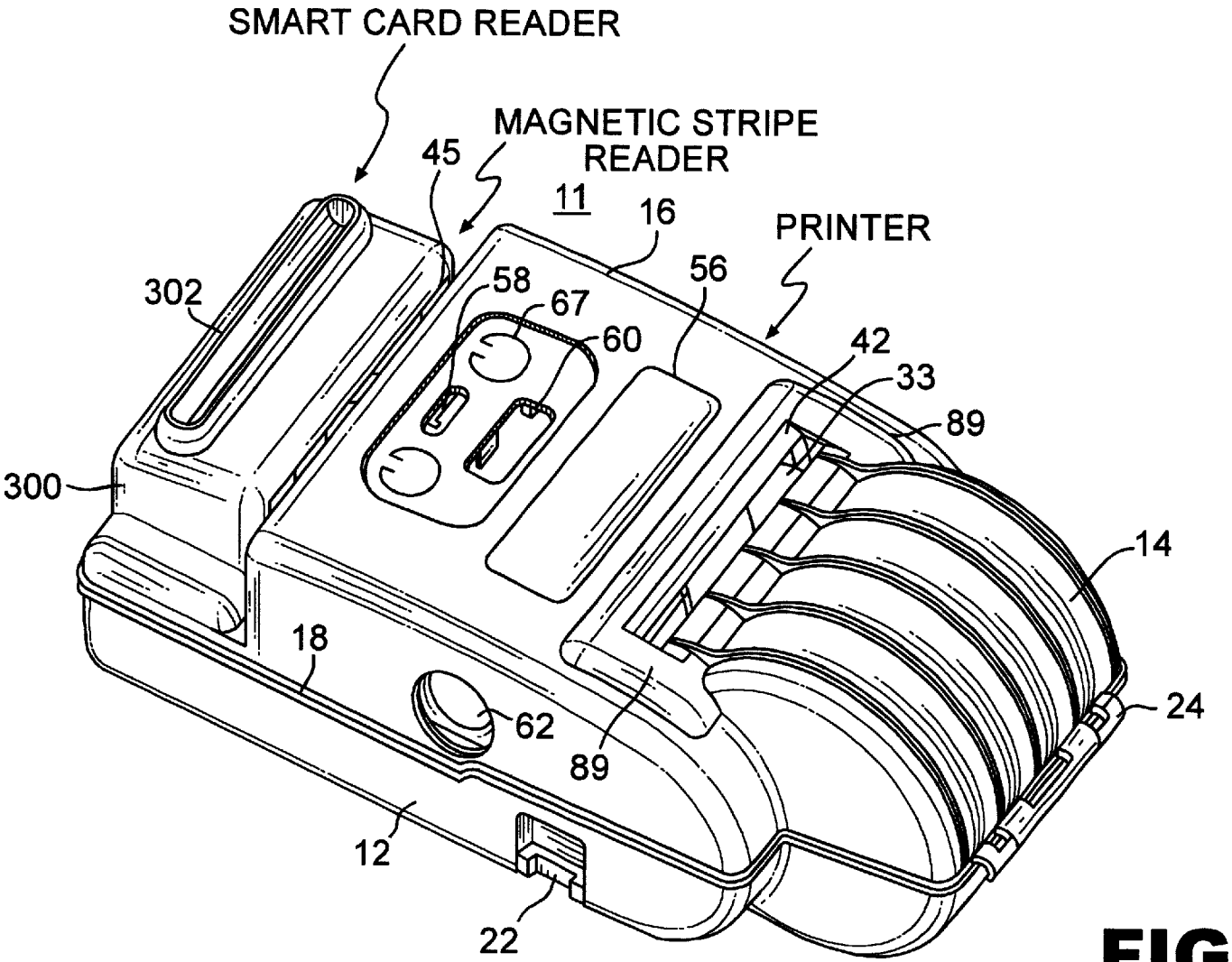
Figure 12:
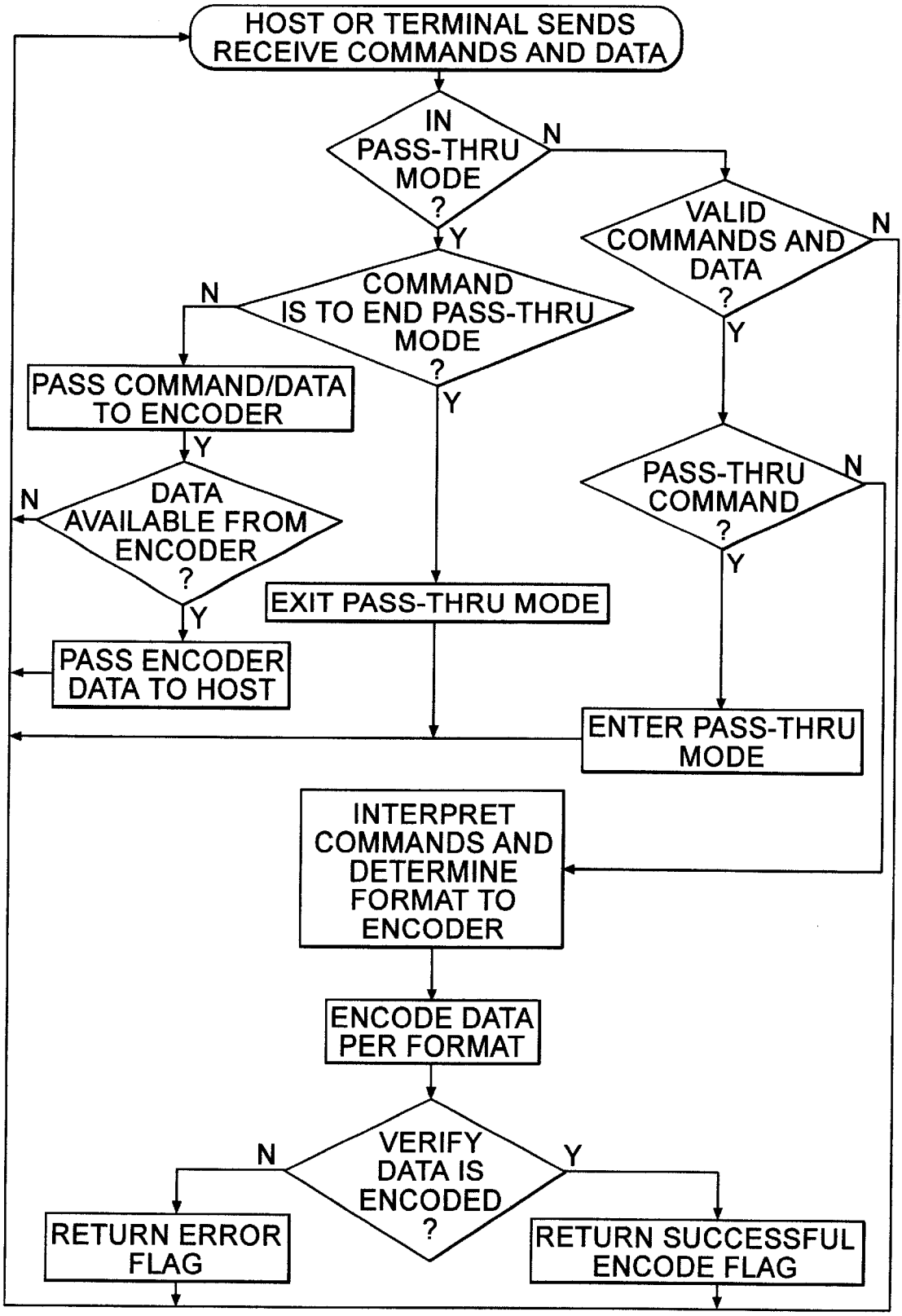

FIGS. 2A and B are side view in the areas within the dash lines 2A and 2B which show the brackets journaling the shaft of the platen roller;

FIG. 3 is a perspective, exploded view of the printer/card reader and encoder unit with the cover which captures the roll of paper in open position as in FIG. 2 and exposing the card reader and encoder and printed circuit board mounting the electronics associated with the printer and card reader and encoder and also showing a battery which is insertable into the housing in a battery compartment on the underside of the housing;

FIG. 4 is a perspective view of the printer mechanism which is contained in the housing and is shown in FIGS. 2 and 3;

FIG. 5 is a side elevational view of the printer mechanism shown in FIG. 4 with the guard over the gear train removed to illustrate the gear train which couples the drive motor to the gear which drives the platen;

FIG. 6 is an exploded view of the printer mechanism shown in FIGS. 4 and 5;

FIG. 7 is a side view of the printer/card reader and encoder unit, which illustrates schematically the location of the battery compartment, the printer circuit board and the card reader in dash lines;

FIG. 8 is a bottom view of the printer/card reader and encoder unit illustrating the battery compartment when closed by cover;

FIG. 9 is a block diagram, schematically depicting the electronics of the printer and card reader and encoder unit;

FIG. 10 is a flow chart illustrating the programming of the microprocessor in the electronics to provide for encoding on the card;

FIG. 11 is a perspective view of a miniaturized printer having all of the features of the printer illustrated in the preceding figures and a separate receptacle for a smart card and its reader and encoder, in accordance with the invention; and FIG. 12 is a flow chart illustrating programming for enabling the printer to operate in pass-through mode, whereby encrypted data is passed directly to the terminal or host computer without printing out in the printer.

Referring to FIG. 1, the miniature printer/card reader and encoder unit 10 shown therein may be approximately seven inches long, three and one-half inches wide and three inches high and weigh less than two pounds. A housing or case 11 encloses the unit and includes a lower housing section 12 and two upper housing sections 14 and 16 which provide covers to close the lower housing section 12 along edges 18, which overlap an indented edge 20 of the lower housing section, which mates therewith. The lower housing section has an opening 22 which exposes a connector 23 (FIG. 7) for a battery charger which charges a battery located in a compartment 122 (FIGS. 7 and 8) on the underside of the lower housing section. The upper housing section 14 is hinged at 24 by means of a hinge 88 to an end of the lower housing section 12, and forms a compartment which encloses a roll of paper 26 (FIG. 2). This is a spindleless roll and may be thermally sensitive paper or paper having thermally sensitive labels thereon. The cover canies a platen roller 28, the shaft 32 of which is journaled in brackets 30 having holes 35 larger than the ends of the platen roller shaft 32 which project therethrough. These holes are oval shaped and permit the platen roller to float and direct the movement of the roller 28 into alignment with a thermal printhead 33 when the cover 14 is closed. The holes 35 with the shaft projections therethrough, are illustrated in FIGS. 2A and 2B. A gear 36 is carried on the platen roller shaft 32 outside one of the brackets 30 and is the final gear of a gear train which rotates the platen roller 28 so as to drive the paper from the roll 26 through an opening 38 formed between the cover 16 and the cover 14, when the cover 14 closes to the position shown in FIG. 1. This opening is defined in part by fingers 89 which extend from the hinged cover 14. The hinge 88 and its pin 90 are shown in FIGS. 3, 7 and 8.

The fixed cover 16 has a ridge or feature 40 which forms a lip guarding a tear bar or strip 42 which projects into the opening 38. The cover 14 has finger holes 43 on opposite sides thereof which may be engaged by the operator to open and close the cover.

The fixed cover section 16 may be attached by screws 17 (FIG. 8) to the lower housing section. These screws extend through bosses 19 (FIG. 3) into threaded holes in other bosses (not shown) in the fixed cover 16. Brackets 44 for screws, which extend into posts 46 projecting from the lower housing section, may be used for attachment of the cover 16 to the lower housing section 12. Alternatively, the cover 16 may be hinged or otherwise flexurally connected along the rear edge thereof to the lower housing section 12.

The cover 16 has a step 48 along its rear edge which provides a base for guidance of a magnetic card through a slot 45 in a block 50 which provides a guide post for the card. A magnetic track reader and writer (encoder) provided by a card reader and writer assembly 80, (FIG. 3) is housed in part under the block 50 for reading data from the track or writing on the track when the card is swiped through the slot 45. A smart card may also be read or encoded when inserted in the slot 45.

The top of the cover has a flexible skin 52 which is attached thereto. The skin is marked with circles 54 defining an on/off button and a feed button to control feeding of the paper through the opening 38. Another area 56 is provided for a label identifying the printer/card reader by its trademark. The skin 52 also has areas over holes 58 for lamps (such as LEDs 59 (FIG. 3) which indicate the operating condition of the device. There is an area over 60 which exposes an infrared transducer for providing communications between the printer/card reader 10 and another device, such as a key board or terminal carried by the user. Communications with the device may be through a connector which is exposed in a hole 62 in the side of the cover 16. Communications with the printer/card reader 10 may also be via a radio link to a transceiver which is housed in the unit on the lower housing 12 under a printed circuit board 76 (FIG. 3).

The housing section 12 and the covers 14 and 16 may be molded from plastic material.

As shown in FIG. 2, there is a side plate 64 which is insertable in any one of a series of slots 66 in a curved side 68 in the body, with side plates 96, of a printer mechanism 70 containing the printhead 33. Tabs on the sides of the slots 66 flex to hold the plate 64 in the selected slot. The slot which is used depends upon the width of the roll 26, and the plate 64 and slots 66 enable rolls of different width to be used in the printer/card reader 10. The plate 64 serves as an edge or end guide for the paper roll 26.

When the skin 52 is removed, the opening 60 which expose the IR transducer and holes 58 which expose the LEDs are visible, as shown in FIG. 2. Arcuate slots 67 are also exposed which permit the housing 16 to flex in the area of the buttons 54 so as to operate switches 72. The switches 72, the LEDs 59 and the IR transducer 74 are mounted on the printed circuit board 76 which is attached to the lower housing by screws into standoff posts 78 projecting from the lower housing, as shown in FIG. 3. The electronics for operating the printer and receiving control signals via the IR transducer or a cable, which is connected to the connector 110, exposed by the hole 62, and also receiving data which is read and which is encoded by the card reader and encoder is an improvement of electronics of the type described in Petteruti U.S. Pat. No. 5,267,800 issued Dec. 7, 1993 or Pat. No. 5,806,993, issued Sep. 15, 1998 and is shown especially adapted for magnetic card reading and encoding in FIG. 9.

Referring again to FIGS. 1 and 2 of the drawing and also to FIGS. 3, 7 and 8, the card reader and encoder assembly 80 includes the magnetic heads for reading and writing magnetic stripes or tracks on cards which are swiped through a guideway structure 82, which is exposed via openings along sides of the slot 45. This assembly 80 is mounted by flanges (not shown) thereon to mounting sites on the bottom housing 12 and also includes means to read and write smart cards. The assembly 80 may be of the type which is commercially available and provides, by way of a cable (not shown), inputs to the electronics which is mounted on the card 76. The electronics reads and encodes the data on the magnetic stripes or smart card and can translate the data which is read into printed characters by energizing appropriate elements of the line of elements 86 on the printhead 34 in appropriate sequence as the paper is driven by the platen past the printhead and out the opening 38 in the cover 16 (FIG. 1). The encoding may also be carried out on the cards when the encoding function is enabled by data applied via the electronics from the terminal, a key board or from the host computer as will be described more fully in connection with FIGS. 9 and 10.

The printing mechanism 70 body is a moldment of plastic which defines the face 68 of the compartment which receives the paper roll 26. The mechanism is attached to the housing section 12 by hold down screws 92 which are accessed via openings 94. The drive motor and gear train 100, two of the gears of which are visible in FIGS. 2 and 3, is mounted outside of one of the side plates 96. The other side plate has a tab 98 with a notch into which an alignment pin 102 from the lower housing section 12 extends to assist in locating the printer mechanism 70 in the lower housing section 12.

The width adjusting (paper roll edge guide) plate 64 has a tongue 104 (see FIG. 4) at the lower tip thereof which extends into notches 105 in the moldment along the lower edge of the surface 68. These grooves 105 are in alignment with the slots 66 which receive tongues 106 at the upper end of the plate 64. These tongues snap into the selected one of the grooves 68 to adjust the width of the roll receiving compartment in the lower end of the housing section 12. The printer/card reader 10 and encoder unit is preferably disposed with the lower end vertically downward so that the weight of the roll provides back tension force on the paper as it is driven between the printhead 33 and the platen 28. The possibility that any loops of paper might be formed which could cause jams is reduced because of the back tension provided by the weight of the roll, which prevents the formation of such loops.

The paper extends over a guide segment 108 which shields an optical detector 201. A slot 110 provides a aperture for light from the optical detector 201 (an opto or optical transmitter receiver) which detects paper in the bight between the printhead and the platen roller 28. This detector is connected to and is part of the sensor circuits 236 shown in FIG. 9. FIG. 6 shows the opto sensor 201 which is mounted in the printing mechanism so that the light source and photodetector thereon are visible through the slot 110.

The printed circuit board 76 (see also FIG. 9) may have mounted on the underside thereof a short or long range radio transceiver 222 for communicating by radio with a central terminal including a central or host computer, a keyboard or keypad 220 on or in any auxiliary terminal carried with the unit on the person of the operator or otherwise attached to the unit may be used. An infrared or other optical transmission link and circuit 228, includes the transducer 74. The host computer or central terminal may be connected to a microprocessor computer 230, with additional memory 238, via a cable in a connector 110 mounted on the underside of the board 76 and exposed through the opening 62 in the upper cover 16. This connector may also be at the end of a cable which connects the printer/card reader 10 to an auxiliary terminal and interface 224, for example with a display 226 and keyboard 220, which may also be in the unit 10, for entering data for printing or encoding for storage on the card. The radio 222 may alternatively be in the auxiliary terminal.

A battery unit 120 is insertable into a compartment 122 (FIGS. 3, 7 and 8) which is accessed by an opening in the bottom side of the lower housing section 12. The battery unit has contacts 124 which engage contacts on a contactor depending from the board 76. Contact is maintained by a latch mechanism including a catch 126 and a finger operated latch 128 which snaps into the catch 126 when the battery is placed in the compartment 122. The battery compartment has tabs (not shown) which are caught in notches 130 longer than the tabs. The battery case 120 is then pivoted downwardly into the compartment until the contacts 124 engage the contact strips depending from the board 76 and the latch 128 holds the battery in place. The battery unit 120 has a built in charger or a connector 23 which is exposed through the side 22 opening of the lower housing section 12 for receiving a cable or a connector from a battery charger or from a source of power for charging the batteries in the unit 120. Power management circuits 228 are associated with the microprocessor and computer 230. A smart card reader/writer 232 may be used to read and write (encode) encrypted data on the smart card, alternatively to the magnetic card reader and encoder 80.

The printing mechanism 70 is shown in greater detail in FIGS. 4, 5, and 6. It will be observed that the printhead 33 is part of an assembly with the tear bar 42 and aback plate 136 having ears 138. The printhead 33 has a line of printing elements 86 and rounded projections 140 which contain circuitry connected to the printing elements in the line of elements 86. This circuitry is part of the printer mechanism control circuits 234 shown in FIG. 9. The printhead is mounted in the side plates 96 by locating the ears 138 into receptacles 142 which are adjacent to fingers 144, which are defined on one side of slots (notches) 146. The ears 138 partially extend into the receptacles 142. Tabs 148 on the faces of the slots 146 are deflected backwardly when the back plate 136 and the ears 138 are inserted into the slots (notches). The tabs engage upper edges 150 and latch the printhead assembly in place.

The slots (notches) 148 are disposed at a small angle, say about 15 degrees to the vertical (best shown in FIG. 5). The front surface 152 of the printhead 33, at which the line of printing elements 86 is located, is inclined at the same angle (about 15 degrees to the vertical). When the paper leaves the slot 38 formed between the upper covers 14 and 16 and the printer/terminal is disposed with the roll receiving compartment downward, the side of the paper on which the printing appears is tilted toward the head of the user. This facilitates the use of the printer/card reader 10.

In order to carry printer and card reader 10 with the roll compartment end downward, a hook, which attaches to the belt of the user, may be inserted in an opening 154 on the bottom side of the housing section 12. This opening is visible in FIG. 8.

The platen drive is provided by a motor 160 mounted on the side plate 96, which also mounts the gear train. The motor 160 may be a stepping motor which is operated by the electronics for printing successive rows of dots with the printhead. This forms characters or symbols which are printed. The drive signals to the motor are obtained from the electronics (the microprocessor 230 and memory 238) carried by the printed circuit board 76, see FIG. 9. The gear train is covered by a guard plate 162 mounted to the side plate on standoffs 164. The drive gear 166 has its speed reduced by a set of double spur gears 168 and 170. The driven gear on the platen roller shaft 36 engages the smaller gear of the double spur gear 170 and is automatically aligned and held in engagement by a latching and biasing system utilizing a pair of wire or hairpin springs 180.

The platen roller shaft 32 extends beyond the ends of the platen roller and receives flanged bushings 182. These bushings limit axial movement of the platen roller 28 and its shaft by occupying the space between the ends of the platen roller and the insides of the brackets 30, which are mounted on the fingers 89 extending from the cover (see FIGS. 1 and 2). The shaft ends project into the opening 35 on the bracket 30 at the left end of the cover as viewed in FIG. 2 (see FIG. 2A). The shaft end extends through the opening 35 and the right side bracket 30, as shown in FIG. 2B, and past that bracket to provide an end on which the driven gear 36 is mounted. There may be a taper or force fit which connects the shaft 32 and the gear 36 so that when the gear is driven the platen roller will rotate and drive the paper through the printing mechanism.

The wire springs 180 are preloaded by virtue of their mounting on the side plates. The springs have ends 188 with right angle tabs 190 that are received in notches 192 in the side plates. The springs are bent over bosses 194 and extend under protective fingers 186 projecting from the sides of the side plates 96. The springs are therefore retained against the outer walls of the sides plates 96. The upper ends of the springs have hook portions 198 and portions 200 extending from the hook portions 198.

In operation, the cover 14 is rotated about its hinge 88 and the small diameter parts 202 of the bushings engage the hook portions 198 and deflect them rearwardly so that the small diameter parts 202 of bushings 182 bypass and snap over the hook portions 198. As the cover continues to rotate the portion 200 underlying the hook portion 198 engages the small diameter portions 202 of the bushings 182. The springs 180, acting at these underlying portions 200, provide a force vector extending in a generally downward direction which can be resolved into force vectors directed to the printhead surface 152 and toward the axis of rotation of the gears 170. These forces permit the platen roller to move within the slots 35 (FIGS. 2A and 2B). These slots restrict the platen roller's motion, and the platen roller can be displaced only into engagement with the printhead, and with the driven gear 36 into engagement with the gear 170 of the gear train 100. Because of the bend of the portion 200 the spring not only biases the platen 28 and gear 36 against the head 33 and gear 170, but also provides a latch, holding the platen in engagement with the printhead and the driven gear 36 in engagement with the last gear 170 of the gear train 100. This engagement can be broken and the platen 28 and its driven gear 36 separated from the printhead and the last gear 170 easily by retracting the cover as by grasping the sides of the cover at the ridged finger holes 43 thereon. The floating connection of the platen to the cover, preferably by means of the slots 35, also enables the platen roller 28 to align itself and distribute evenly the force exerted by the platen roller against the printhead element 86 via the paper.

Referring to FIG. 11, there is shown a miniature printer in accordance with another embodiment of the present invention. This printer is similar so far as its printer mechanism and controls is concerned as the printer shown in the preceding figures and like parts are illustrated by like reference numerals. The hinged cover 14 is provided with ribs across which the paper may move with minimal frictional resistance when it is not desired to tear off sections of the paper after printing of labels or other materials thereon. The housing 12 has an enclosed rear deck 300 which forms one side of the slot 45 to which the magnetic card may be swiped for reading and/or encoding thereon of data to be printed or passed-through to the host or terminal when the pass-through mode is enabled (see FIG. 12). In other words, the slot 45 provides a receptacle in the housing or case 16 for the magnetic card.

The deck 300 also has a receptacle 302 into which the smart card may be inserted and from which the card may be removed after data read thereon is printed or passed-through to the host without printing. The enclosure includes a commercially available smart card reader and coder whereby data may be passed via a transducer or a connector which contacts conductors on the smart card.

The encoding of data from the host or terminal may be carried out by the program illustrated in FIG. 10, which program may be installed in the microprocessor 230 or its additional memory 238. When it is desued to implement the pass-through mode (without printing), the program illustrated in FIG. 12 may be used.

From the foregoing description it will be apparent that there has been provided an improved miniature printer/card reader and encoder which is compatible with the target cost objectives for such units. An improved printing mechanism which is especially adapted to be miniaturized and used in portable equipment is used in printer/card reader and encoder. Variations and modifications in the herein described apparatus, within the scope of the invention, will undoubtedly suggest themselves to those skilled in the art. Accordingly, the foregoing description should be taken as illustrative and not in a limiting sense.

What is claimed is:

1. A portable, miniaturized printer comprising a printing mechanism, a magnetic card reader and writer, and means internal to said printer for encoding data on a magnetic stripe on the card, said portable, miniaturized printer including said mechanism, reader and writer, and said encoding means, being, an integrated assembly of a weight less than two pounds.

2. The printer according to claim 1 further comprising means in said assembly and integral to said printer for writing said encoded data on the magnetic stripe.

3. A portable, miniaturizedprinter comprising a printing mechanism, a smart card, and reader means internal to said printer for reading data encoded in the smart card, said portable, miniaturized printer, including said mechanism, smart card, and reader means, being an integrated assembly of weight less than two pounds.

4. The printer according to claim 3 further comprising smart card writer means, integral with said assembly for encoding data into the smart card.

5. A printer comprising a housing, a printing mechanism in said housing, means for feeding paper via said mechanism for printing thereon and out of said housing, a data card receiving receptacle in which said card is removably disposed in said housing, means internal to said printer and said housing for processing data signals read from said card for enabling printing by said mechanism on said paper corresponding to said signals, and means internal to said printer and in said housing for processing signals for encoding into data for storage on said card, said housing, said mechanism, feeding means, receptacles and both said processing means being a miniaturized integrated assembly.

6. The printer according to claim 5 wherein said card is selected from the group consisting of a smart card carrying an integrated circuit and a magnetic card carrying a magnetic stripe.

7. The printer according to claim 6 wherein said card is a magnetic card and said reading receptacle is a slot via which said card is swiped past and magnetic head facing said slot.

8. The printer according to claim 6 wherein said card is a smart card, and a smart card reader and writing element in said receptacle for reading and encoding data signals in said smart card integrated circuit.

9. The printer according to claim 5 wherein a pair of receptacles are provided for separately removably receiving a smart card and a magnetic card.

10. The printer according to claim 9 wherein said means provided for processing signals include separate processing means for signals read from and for writing on said magnetic card and for signals read from and for encoding into data or storage on said smart card.

11. The printer according to claim 10 wherein said processing means for said smart card and said magnetic card are both operative to enabling printing of data by said printing mechanism on said paper.

12. The printer according to claim 11 wherein a terminal for handling data is coupled to said printer for accessing data from said processing means from a card received in said housing selectively without enabling printing of said data with said printing mechanism.

13. A method of programming a printer linked in communication relationship to a terminal remote from said printer comprising the steps of first programming said printer to read or encode a magnetic or smart card insertable into said printer to first read data stored on a magnetic or smart card and, then programming the said printer to pass said data through to said terminal.

14. The method of claim 13 further comprising the step of receiving data from said terminal and encoding said received data and storing said received data on said card.

15. The method of claim 14 wherein said data is encrypted data.

* * * * *

UNITED STATES PATENT AND TRADEMARK OFFICE

CERTIFICATE OF CORRECTION

PATENT NO. : 6,364,550 B1
DATED : April 2, 2002
INVENTOR(S) : Steven F. Petteruti It is certified that error appears in the above-identified patent and that said Letters Patent is hereby corrected as shown below:

Title page,
Item [73], Assignee, should read -- ZIH Corp., Hamilton, Bermuda --.

Signed and Sealed this

Seventeenth Day of August, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,364,550 B1
DATED : April 2, 2002
INVENTOR(S) : Petteruti

It is certified that error appears in the above-identified patent and that said Letters Patent is hereby corrected as shown below:

Title page,
Item [*] Notice, delete the phrase “by 0 days” and insert -- by 26 days --

Signed and Sealed this

Fifth Day of October, 2004

JON W. DUDAS
*Director of the United States Patent and Trademark Office*